United States Patent [19]

Katanosaka et al.

[11] 3,931,315

[45] Jan. 6, 1976

[54] ALICYCLIC AMINO COMPOUNDS AND THEIR PRODUCTION

[75] Inventors: Akisato Katanosaka, Toyonaka; Manabu Hanamoto, Daito, both of Japan

[73] Assignee: Nard Institute, Ltd., Japan

[22] Filed: Oct. 11, 1973

[21] Appl. No.: 405,640

[30] Foreign Application Priority Data

Oct. 11, 1972 Japan ..... 47-101701

[52] U.S. Cl. ..... 260/563 P

[51] Int. Cl.[2] ..... C07C 87/40

[58] Field of Search ..... 260/563 P

[56] References Cited

UNITED STATES PATENTS

| | | | |
|---|---|---|---|
| 2,635,979 | 4/1953 | Lidov | 260/563 P X |
| 3,505,402 | 4/1970 | Raff et al. | 260/563 P |
| 3,595,917 | 7/1971 | Trecker et al. | 260/563 P |

*Primary Examiner*—Paul F. Shaver

*Attorney, Agent, or Firm*—Wenderoth, Lind & Ponack

[57] ABSTRACT

An alicyclic amino compound of the general formula:

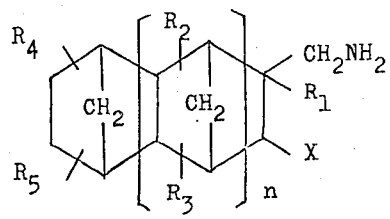

wherein $R_1$, $R_2$, $R_3$, $R_4$ and $R_5$ are each hydrogen or alkyl having 1 to 6 carbon atoms; X is each hydrogen, alkyl having 1 to 6 carbon atoms or aminomethyl; *n* is an integer of 1 or 2, and their production. The subject compound is useful as a cationic surfactant, complexing agent and intermediate.

5 Claims, No Drawings

ALICYCLIC AMINO COMPOUNDS AND THEIR PRODUCTION

The present invention relates to novel alicyclic amino compounds and their production.

As already known, a higher fatty amine, which is obtained by cycanation and then reduction of a higher fatty acid is generally used as a raw material for a cationic surface active agent. However, a higher fatty acid is naturally utilized for food and it is not desirable to utilize same for industrial purposes considering the unfavorable food situation in the world. Further, a higher fatty amine does not have a sufficient affinity with other materials when used as a cationic surface active agent. Besides, an aminomethyl derivative of natural rosin which is an alicyclic carboxylic acid is also utilized as a cationic surface active agent and is superior to the said higher fatty amine in various properties and characteristics. However rosin is also naturally occuring and its supply is not stable.

A main object of the present invention is to provide a novel alicyclic amino compound having properties and characteristics required for a cationic surface active agent and being superior to those of a higher fatty amine.

Another object of the present invention is to provide a process for manufacturing the smae from abundant but unutilized materials such as thermal cracking products of petroleum naphtha or coal (e.g. dicyclopentadiene (DCPD) or its analogous compound).

These and other advantages and objects of the present invention will be apparent from the following description.

The alicyclic amino compound of the present invention has the following chemical structure:

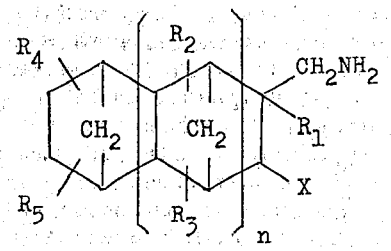

[I]

wherein $R_1$, $R_2$, $R_3$, $R_4$ and $R_5$ are each hydrogen or alkyl having 1 to 6 carbon atoms; X is hydrogen, alkyl having 1 to 6 carbon atoms or aminomethyl; n is an integer of 1 or 2.

The alicyclic amino compound [I] of the present invention is obtained by hydrogenating the following alicyclic cyano compound of the general formula:

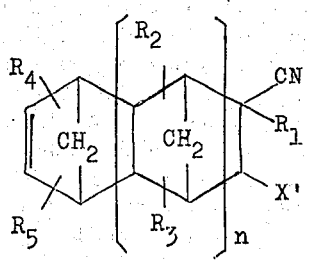

[II]

wherein $R_1$, $R_2$, $R_3$, $R_4$, $R_5$ and $n$ are each as defined above; X' is hydrogen, alkyl having 1 to 6 carbon atoms, aminomethyl or cyano.

The starting compound [II] is already known and the ring skeleton can be further illustrated as follows.

n = 1

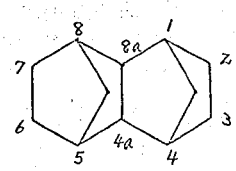

[II-1]

n = 2

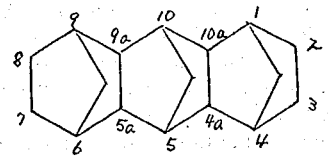

[II-2]

The starting compound [II] corresponding to the ring skeleton of [II-1] and [II-2] can be prepared by reacting one mole of $\alpha$, $\beta$-unsaturated cyano compound such as acrylonitrile, methacrylonitrile, maleonitrile, etc. with two or three moles of cyclopentadiene (CPD) or its alkyl substituted derivative(alkyl CPD), though DCPD is industrially applied in place of CPD. For example, when a mixture of acrylonitrile and DCPD is heated at 170°–200°C, a first step addition reaction proceeds rapidly to form 5-cyanobicyclo[2,2,1]heptene-2(i.e. 2-cyanonorbornene) which is an equimolar adduct of acrylonitrile and CPD, and the adduct is further reacted with CPD that is present in the reaction system to prepare 1,2,3,4,4a,5,8,8a-octahydro-2-cyano-1,4-methano-5,8-methanonaphthalene corresponding to the bing skeketon of [II-1] and the compound [II-1] is further reacted with CPD that is present in the reaction system to prepare 1,2,3,4,4a,5, 5a, 6,9, 9a, 10, 10a-dodecahydro-2-cyano-1,4-methano-5,10-methano-6,9-methanoanthracene corresponding to the ring skeleton of [II-2].

As apparent from the above description, the starting compound [II] is prepared as a mixed state of the compound [II-1] and [II-2]. These compounds can be subjected to hydrogenation of the present invention without any obstruction and they are useful for a cationic surface active agent even as a mixed state. While, if each isolated object compound [I] is desirable, they may be separated by fractional distillation employing the difference of boiling point before or after hydrogenation of the present invention. However, the starting compounds [II] wherein $n$ is 2 especially X' is cyano are difficult to purify since they have a higher boiling point. Accordingly, they may be obtained as residue after fractional distillation. Therefore, the balance of hydrophobic and hydrophilic (HLB) can be easily controlled in the present invention by adjusting the number distribution of $n$ in the starting compound [II].

It is further apparent from the above description that higher adducts of $\alpha$, $\beta$-unsaturated nitrile and CPD may be produced as by-products and the compound contaminated with higher adducts may also be utilized for a cationic surface active agent. However, if it is desirable to obtain the starting compound [II] in high yield, it is recommended to conduct the addition reaction at 180°–200°C and to complete the reaction within 4–8 hours.

The hydrogenation reaction of the present invention can be properly selected from various well known processes that are commonly applied for the reduction of cyano group and olefinic group. Cyano group(s) of the starting compound [II] are easily converted to aminomethyl group(s) by hydrogenation. A double bond between carbon-carbon atoms is simultaneously hydrogenated according to the hydrogenation condition, since the olefinic group is reactive to the conventional hydrogenation reaction.

Suitable hydrogenation reactions include, for example, catalytic reduction; electrolytic reduction; hydrogenation reaction in the presence of metalic sodium and an organic solvent such as ethanol, benzene, toluene, etc.; hydrogenation reaction with sodium hydroxide in the presence of nickel, sodium hypophosphite and hydrated ethanol; hydrogenation reaction with lithium aluminium hydride or sodium boron hydride; hydrogenation reaction in the presence of chromium acetate, and the like.

Among the above mentioned hydrogenation reactions, the catalytic reduction is most preferably applied to the starting compound [II] in the present invention. Therefore, the catalytic reduction is further disclosed in detail as follows. The said reduction can be carried out in the liquid phase or gaseous phase under an atmospheric pressure or an elevated pressure. Catalysts utilized herein include various well know reductive catalysts such as heavy metal e.g. platinium, palladium, nickel, cobalt, cupper, iron, etc.; an activated variety of said heavy metal e.g. Raney-nickel, Raney-cobalt, Raney-iron, Urusibara-nickel, Urusibara-coblat, etc.; the said heavy metal on carrier e.g. palladium-carbon, nickel-diatomite, etc., and the like.

Suitable solvents utilizable for the catalytic reduction include, for example, an alcoholic solvent e.g. methanol, ethanol, propanol, etc.; other unreductive organic solvent e.g. cyclohexane, tetrahydrofuran, etc. and the like. The catalytic reduction can be further carried out in the molten state without solvent. The reaction temperature and pressure can be properly decided according to the utilized reduction catalyst. For example, in the case of nickel-diatomite or Raney-nickel, the hydrogenation reaction was carried out by heating at 140°–180°C for one to eight hours under the pressure between 10–200 Kg/cm$^2$ with hydrogen gas. According to catalytic reduction, double bond is hydrogenated as well as cyano group.

While, it is well known that the secondary amine may be simultaneously produced as a by-product in the hydrogenation reaction of cyano group. Therefore, it is recommended to conduct the reaction in the presence of ammonia to avoid side reaction. Otherwise, it is also recommendable to conduct the reaction with the specific catalyst such as Raney-nickel or Raney-cobalt and with the basic promoter such as sodium acetate in the presence of acetic anhydride, or to complete the reaction at an earlier stage.

An alicyclic amino compound [I] of the present invention is manufactured from abundunt but unutilized materials such as thermal cracking products of petroleum naphtha or coal (e.g. DCPD or its analogous compound) and is a liquid or resinous material.

The said compound has superior affinity with other chemical materials in comparison with various higher fatty amines. Further, the said compound is not absorbed in the bodies of a human, a cattle and fish, and is not stimulant for their skin. Furthermore, the said compound is non-volatile. Therefore, an alicyclic amino compound (I) is manageable and utilizable as a cationic surface active agent for several uses as described below.

A. An acid salt of an organic acid or a mineral acid such as acetic acid, hydrochloric acid, etc.

The salt is so-called a cationic soap and is utilizable as an emulsifying agent of an emulsion added to a latex, a printing ink, a pigment, etc.; a floatation agent; a sizing agent; an emulsifying agent in emulsion polymerization and the like.

The said cationic soap has an exellent wettability and an affinity with various chemical materials as well as a satisfactory emulsifying effect and a washing effect.

Therefore, the cationic soap exhibits superior properties and characteristics to a fatty amine cationic soap. While, HLB of the cationic soap can be adjusted to the most suitable value as mentioned above. Accordingly, the said soap is utilizable as an emulsifying agent in emulsion polymerization.

B. A complex with pentachlorophenol, copper acetate or sodium disulfide, etc.

The complex is utilizable as an antifungal agent and an insecticide in several kinds of detergent and the like.

The antifungal effect of the complex is superior to that of the general fatty amine. The detergent can be safely used without any harm for a human and a food.

C. A quaternary ammonium salt of aralkyl chloride, alkyl chloride or alkylene oxide such as benzylchloride, propylchloride, ethylene oxide, propylene oxide, etc.

The quaternary ammonium salt is utilizable as an insecticide in several kinds of detergents.

D. An aminoalkyl derivative such as an aminopropyl derivative which is obtained by cyanoethylation of aminoalkyl group in the alicyclic amino compound (I) and then by reduction to change the cyanoethylaminoethyl group to an aminopropylaminomethyl group.

The aminoalkyl derivative is utilizable as an emulsifying agent for an asphalt emulsion; an anti-stripping agent; anti-corrosive agent and the like.

The aminoalkyl drivative is stable and when it is utilized as an emulsifying agent of an emulsion, emulstion, pavement works are easily performed with good results and the adhesive property between asphalt and aggregate is quite satisfactory. The aminoalkyl derivative is further utilizable as an anti-corrosive agent which has a good affinity with the material to be protected. Accordingly, it is expected to exhibit a strong anti-corrosive effect over a long period.

E. A polyethylene glycolate derivative which is obtained by reacting the alicyclic amino compound (I) with polyalkylene oxide such as polyethylene oxide, polypropylene oxide, etc.

The polyethylene glycolate derivative is utilizable as an anti-corrosive agent, an anti-static agent, a detergent, a lubricant, a dying assistant and the like.

When the polyethylene glycolate derivative is used as an anti-corrosive agent, it exhibits an exellent absorption ability on a metal surface and an exellent affinity with another anti-corrosive agent used therewith.

Examples of the present invention are given below for a better undrstanding of the present invention, in which all percentages and parts are by weight.

EXAMPLE 1

In an autoclave were charged 530 g of acrylonitrile and 1320 g of DCPD, the resultant mixture was heated at 180°–200°C for 6 hours with stirring. After the reaction was over, the reaction mixture was subjected to distillation to remove the low boiling point distillate at 180°C under an atmospheric pressure and the residue was further subjected to distillation. Five hundred and thirty grams of the first distillate were obtained up to 130°C/6mmHg, and then 840 g of the second distillate was obtained between the temperature of 131°C/6mmHg and 150°C/5mmHg and further 200 g of the third distillate was obtained between the temperature of 151°C/5mmHg and 180°C/1mmHg. The first distillate was a colorless and transparent liquid having a molecular weight of 120. The results of elementary analysis and infra-red absorption (IR) spectrum shown that the first distillate was 5-cyanobicyclo[2,2,1]heptene-2. The second distillate was a colorless and transparent liquid having a molecular weight of 185. The liquid crystallized on standing. The result of IR spectrum shown that the crystal was 1,2,3,4,4a, 5,8,8a-octahydro2-cyano-1,4-methano-5,8-methanonaphthalene having a melting point of 60°C. The third distillate was crystallized immediately after distillation. The resulting white crystals had a molecular weight of 250 and a melting point of 160°C. The result of IR spectrum shown that the crystal was 1,2,3,4,4a, 5,5a, 6,9,9a, 10, 10a-dodecahydro2-cyano-1,4-methano-5,10-methano-6,9-methanoanthracene.

Thus obtained crystals were respectively hydrogenated to obtain the corresponding aminomethyl derivative as follows.

In an autoclave were charged 100 g of each cyano compound, 100 g of methanol and 2 g of Raney-nickel catalyst. After the air in the autoclave was displaced with hydrogen gas, 40 g of liquid ammonia was charged and then the resultant mixture was heated at 160°C for 4 hours with stirring under the pressure of 200kg/cm² with hydrogen gas. After the reaction was over, the catalyst was filtered off and methanol was distilled off to obtain each 99 g of the corresponding aminomethyl derivative. The aminomethyl derivative obtained from the second distillate was a yellowish liquid and had a molecular weight of 190 and a primary amine value of 275(the theoretical value: 294). The results of IR spectrum shown that the said liquid was a perhydro-2-aminomethyl-1,4-methano-5,8-methanonaphthalene. The amino compound obtained from the third distillate was a yellowish and balsamic material, and had a molecular weight of 255 and a primary amine value of 210 (the theoretical value: 218). The results of IR spectrum shown that the said balsamic material was a perhydro-2-aminomethyl-1,4-methano-5,10-methano-6,9-methanoanthracene.

EXAMPLE 2

Five hundred grams of DCPD were added dropwise over 5 hours into 1,190 g of 5-cyanobicyclo[2,2,1] heptene-2 which was heated at 170°C with stirring. The reaction mixture was distilled to remove low boiling point materials up to 130°C/60mmHg, whereby 340 g of a pale yellowish liquid was obtained as a residue. The said liquid had a number average molecular weight of 200 and the results of chromatography and spectroanalysis showed that it was a mixture of about 95% of 1,2,3,4,4a, 5,8,8a-octahydro-2-cyano-1,4-methano-5,8-methanonaphthalene, about 5% of 1,2,3,4,4a,5-,5a,6,9,9a, 10,10a-dodecahydro-2-cyano-1,4--methano-5,10-mehtano-6,9-methanoanthracene and a small amount of higher polymerized compounds.

In an autoclave were charged 100 g of thus obtained cyano compound and 2g of Raney-nickel catalyst. After the air in the autoclave was displaced with hydrogen gas, 40g of liquid ammonia was charged, and the resultant mixture was heated at 150°–160°C for 4 hours with stirring under the pressure of 200Kg/cm² with hydrogen gas. After the reaction was over, the catalyst was filtered off to obtain 100g of the corresponding amino compound being a yellowish liquid. The said amino compound had a number average molecular weight of 205, a primary amine value of 276. The resulting compound was a mixture of perhydro-2-aminomethyl-1,4-methano-5,8-methanonaphthalene and perhydro-2-aminomethl-1,4-methano-5,10-methano-6,9-methanoanthracene.

EXAMPLE 3

5,6-Dicyanobicyclo[2,2,1]heptene-2 and DCPD were reacted in the same way in Example 2 excepting the reaction temperature (190°C) to prepared 1,2,3,4,4a,5,6,9,9a,10,10a-dodecahydro-2,3-dicyano-1,4-methano-5,10-methano-6,9-methanonaphthalene as a main component. Thus obtained dicyano compound was hydrogenated in the same way as in Example 2 to obtain perhydro-2,3-diaminomethyl-1,4-methano-5,10-methano-6,9-methanoanthracene.

Each amino compound obtained in Example 1 to 3 was examined as follows.

EXAMPLE 4

Each amino compound (3.5 parts), carnauba wax (35 parts) and 10% aqueous solution of acetic acid (7 parts) were added to water (54.5 parts) to prepare an emulsion respectively. Thus obtained emulsion exhibited a sufficient affinity with a printing ink, a floatation agent and a pigment. Further, the said emulsion exhibited a sufficient effect in emulsion polymerization for production of styrene polymer as follows.

The emulsifying agent (2.5 parts), which was prepared by dispersing each amino compound obtained in Example 1 to 3 into 10% aqueous solution of acetic acid, was added to a polymerization reaction system including the mixture of styrene (100 parts), pure water (200 parts), azobisisobutylonitrile (0.1 part) and ferrous sulfate (0.05 parts). Then, polymerization reaction was carried out at 60°C. Each amino compound obtained in example 1 to 3 could give a stable emulsion as well as rosin amine.

The second distillate obtained in Example 1 shown about 85–90% of polymerization degree after 1.5 hours.

EXAMPLE 5

Each amino compound obtained in Example 1 to 6 was reacted with pentachlorophenol to give the corresponding complex. The antifungal effect of the complex was examined respectively. Each complex (2%) was added to an oil paint, and kept in a humid place for one year to observe an occurrence of mold. Every oil paint which contained the said antifungal agent was not mildewed, though an oil paint without the antifungal agent became mildewed after 6 months, and an oil paint to which a beef tallow amine was added became mildewed after one year.

The second distillate obtained in Example 1 and the amino compound obtained in Example 3 were not mildewed in the relative humidity of 97%.

EXAMPLE 6

An acetic acid salt(2%) of each of the amino compounds obtained in Examples 1 to 3 was respectively added to a pulp slurry, then a calcium carbonate paper was prepared in the conventional method. An aqueous ink did not blot on the said paper.

EXAMPLE 7

Each of the amino compounds obtained in Examples 1 to 3, Rosin amine-D(Hercules Inc. in U.S.A.) adn beef tallow amine were reacted with ethylene oxide in the conventional method to obtain the corresponding polyethylene glycolate.

A steel plate was treated with thus obtained polyethylene glycolate to prevent corrosion. The steel plate was examined for the degree of corrosion by 2%, 6% and 12% of hydrochloric acid aqueous solutions at 70°C. The thickness of the corroded steel during one hour was shown in Table 1.

Table 1

| Concn. of hydrochloric acid aqueous solution | 2% | (unit: μ) 6% | 12% |
|---|---|---|---|
| Amino compound | | | |
| Example 1(1st distillate) | 0.49 | 0.88 | 1.22 |
| Example 1(2nd distillate) | 0.08 | 0.12 | 0.28 |
| Example 2 | 0.41 | 0.76 | 1.36 |
| Example 3 | 0.69 | 1.11 | 1.39 |
| Rosin amine-D | 0.10 | 0.15 | 0.30 |
| Beef tallow amine | 0.66 | 0.90 | 1.42 |
| Nothing | 13.5 | 19.9 | 27.0 |

EXAMPLE 8

To 225g of the amino compound (a number average molecular weight: 255, a primary amine value: 210) obtained from the second distillate in Example 1, 159g of acrylonitrile and 0.3 g of sodium hydroxide were added, and then the resultant mixture was heated at 70°–75°C for 3 hours with stirring. After the reaction was over, the reaction mixture was heated under reduced pressure to remove the unreacted acrylonitrile, whereby 293g of the corresponding cyanoethylamino compound were obtained as a yellowish balsamic material. In an autoclave were charged 193 g of thus obtained cyanoethyl compound and 6g of Raney-nickel. After the air in the autoclave was displaced with hydrogen gas, 80g of liquid ammonia was charged in the autoclave, and then the resultant mixture was heated at 130°C for 4 hours under the pressure of 60Kg/cm$^2$ with hydrogen gas. Thereafter, the hydrogen gas and ammonia gas were discharged, and the catalyst in the reaction mixture was filtered off under heating and pressure to obtain 286g of a yellowish and viscous liquid. The liqued was a perhydro-2-aminopropylaminomethyl-1,4-methano-5,10-methano-6,9-methanoanthracene (abbreviated as a diamine hereinafter) having a total amino value of 342 and a partial amino value of 169.

Then, the diamine was examined as an emulsifying agent for an asphalt emulsion and as an antistripping agent for an asphalt and an aggregate. For the sake of contrast, a stearylpropylenediamine and dihydroabietylpropylenediamine obtained from each stearylamine and rosin amine in the same method as described above, were respectively examined.

A hundred grams of straight asphalt(paraffine base: Fuji Kosan Co., Ltd. in Japan, penetration was 80–100) and 0.3g of the said diamine were mixed and heated at 120°C. The resultant mixture was kept for 5, 10 and 24 hours at 180°C. Five grams of the treated asphalt were added to 100g of broken stones (all of them pass through a standard ¾ inch screen and not more than 5% will pass through a ¼ inch screen, collected in Takarazuka city, Japan) which was dried over at 130°C for 3 hours after washing. The resultant mixture was mixed at 130°C for 3 minutes with a bamboo spatula in a 200ml stainless beaker, whreby the surface of the stone was coated with the asphalt. After cooling on a glass plate, the coated stone was dipped in hot water of 80°C for 30 minutes to strip the asphalt from the surface of the stone. The stripping rate(%) was shown in Table 2.

Table 2

| Heat treating time (at 180°C) | Stripping rate(%) 0 | 5 | 10 | 24 (hours) |
|---|---|---|---|---|
| Mixed diamine of the present invention | 0 | 0 | 11 | 22 |
| Stearylpropylene-diamine | 0 | 0 | 14 | 24 |
| Dihydroabietylpropylene-diamine | 0 | 0 | 12 | 23 |
| Nothing | 60 | 70 | 80 | 85 |

One gram of the said each diamine was added to 150 g of water, and hydrochloric acid was added to adjust pH to 2.0. The diamine was dissolved in water. Further, 0.3g of calcium chloride was dissolved in the solution to prepare an emulsifying agent solution. The solution was maintained at 60°C in a 500ml stainless flask. In the flask, 183g of molten straight asphalt at 120°–130°C (paraffin base: Fuji Kosan Co., Ltd. Japan, penetration was 150–200) was charged and the mixed material was emulsified by a homogenizer to obtain the asphalt emulsion. Storage stability for asphalt emulsion was examined according to the methods authorized as JIS-K-2208(Japanese Industrial Standard) as follows.

The asphalt emulsion was maintained at room temperature for 5 days in a 250ml measuring cylinder. Thereafter, each 50g of the emulsion was respectively picked out from upper layer and lower layer. The difference of non-volatile component percentage between the each layer was considered as a measure of storage stability as shown as in Table 5.

Table 3

| Emulsifing agent | Storage stability | Englar viscosity |
|---|---|---|
| Mixed diamine of the present invention | 2.4 | 3.9 |
| Stearylpropylene-diamine | 2.4 | 3.6 |
| Dihydroabietyl-propylenediamine | 2.6 | 3.7 |

What is claimed is:

1. An alicyclic amino compound of the general formula:

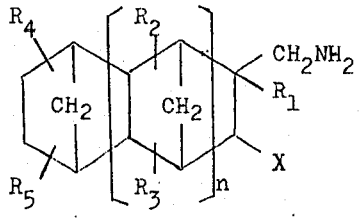

wherein $R_1$, $R_2$, $R_3$, $R_4$ and $R_5$ are each hydrogen or alkyl having 1 to 6 carbon atoms; X is hydrogen, alkyl having 1 to 6 carbon atoms or aminomethyl; *n* is an integer of 1 or 2.

2. The alicyclic amino compound claimed in claim 1 wherein $R_1$, $R_2$, $R_3$, $R_4$, $R_5$ and X are each hydrogen; *n* is 1.

3. The alicyclic amino compound claimed in claim 1 wherein $R_1$, $R_2$, $R_3$, $R_4$, $R_5$ and X are eacy hydrogen; *n* is 2.

4. The alicyclic amino compound claimed in claim 1 wherein $R_1$, $R_2$, $R_3$, $R_4$ and $R_5$ are each hydrogen; X is aminomethyl; *n* is 2.

5. A process for producing an alicyclic amino compound of the general formula:

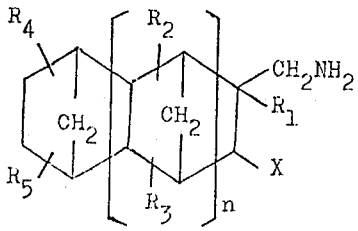

wherein $R_1$, $R_2$, $R_3$, $R_4$ and $R_5$ are each hydrogen or alkyl having 1 to 6 carbon atoms; X is hydrogen, alkyl having 1 to 6 carbon atoms or aminomethyl; *n* is an integer of 1 or 2, which comprises hydrogenating an alicyclic cyano compound of the general formula:

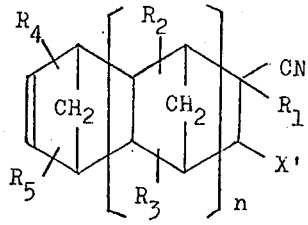

Wherein $R_1$, $R_2$, $R_3$, $R_4$, $R_5$ and n are each as defined above; X′ is each hydrogen, alkyl having 1 to 6 carbon atoms, aminomethyl or cyano.

* * * * *